US005198600A

United States Patent [19]

E'Nama

[11] Patent Number: 5,198,600

[45] Date of Patent: Mar. 30, 1993

[54] MOUNT FOR RIFLE

[75] Inventor: David J. E'Nama, Willow Grove, Pa.

[73] Assignee: Havis-Shields Equipment Corporation, Warminster, Pa.

[21] Appl. No.: 885,867

[22] Filed: May 20, 1992

[51] Int. Cl.[5] ..... F41C 27/00

[52] U.S. Cl. ..... 42/90; 42/105; 89/14.1

[58] Field of Search ..... 42/1.15, 75.01, 86, 42/90, 93, 94, 97, 103, 105; 89/14.1, 40.06, 41.17; 362/110, 111, 112, 113, 114

[56] References Cited

FOREIGN PATENT DOCUMENTS 717800 2/1942 Fed. Rep. of Germany ..... 89/40.06

*Primary Examiner*—Stephen C. Bentley

*Attorney, Agent, or Firm*—Zachary T. Wobensmith, III

[57] ABSTRACT

A mount for rifles is provided, located under the barrel to allow the rifles to carry accessories such as lights, lasers, grenade and flare launchers thereon which mount fits existing rifle configurations without modification to the basic rifle components.

2 Claims, 2 Drawing Sheets

MOUNT FOR RIFLE

BACKGROUND OF THE INVENTION

1. Field of the Invention

This invention relates to an under the barrel type mount for rifles, which detachably carries accessory items, which slide on and off the mount as required for assembly and disassembly.

2. Description of the Prior Art

With the development of modern light weight military rifles such as the M-16 series developed by Colt Industries, Hartford, Conn., which are designed to be used in multiple roles, it has become increasingly important to increase their operational capabilities to be able to project grenades, flares and other items.

The M-16 series of rifles are available from Colt and others in various configurations of barrel length, and stock type from fixed to telescoping.

The use of rifles, which can launch flares, grenades, and carry lights, and lasers under the barrel for various roles in a military type setting is not new. Many rifles launch flares, and grenades directly from the rifle barrel by use of a special blank cartridge, which while useful, is limited to special types of such items which are propelled from the rifle itself. Of late, there has been interest in providing the M-16 rifle series with under barrel mounted items, where mounting does not interfere with normal use of the rifle. Such devices are laser projection devices, with visible or invisible (infared) devices and grenade or flare launchers which improve the versalitity of the rifle. One such device is disclosed in the E'nama U.S. Pat. No. 5,064,988. However, the E'nama et al device requires modification to the rifle, does not provide the quick detachable features desired, and does not disclose provisions for mounting flare or grenade launchers.

Various flare, and grenade launchers, such as the M-79 grenade launcher, and M-203 flare launcher, which use 40 MM or 37 MM flares or grenades, in self-contained cartridges, have been developed. Such launchers have been modified to mount to the M-16 series of rifles, and this usually requires modification to the rifle, but does not provide a universal type mount which can accommodate various accessory devices such as flare launchers, grenade launchers, and lights, both visible and invisible.

The mount of the invention permits under barrel detachable mounting to the rifle of various accessory items without modification to the basic structure of the rifle.

SUMMARY OF THE INVENTION

A mount for rifles is provided that is located under the barrel, does not require modification to the basic structure of the rifle, and is engaged with various parts of the rifle in a positive fixed condition, but which can be easily removed and, detachably carries various accessories thereon.

The principal object of the invention is to provide a mount for a rifle that detachably carries a variety of accessories, that can be slid on and off the mount, and whose operation does not interfere with the normal operation of the rifle.

A further object of the invention is to provide a mount for rifles that is sturdy and reliable.

A further object of the invention is to provide a mount for rifles that does not require modification of the basic rifle configuration, and can be used with a variety of rifles.

A further object of the invention is to provide a mount for rifles that provides for easily and quickly attaching and detaching accessories, which are securely retained when engaged with the mount.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be made in the structure disclosed without departing from the spirit of the invention.

Like numerals refer to like parts throughout the several views.

DESCRIPTION OF THE PREFERRED EMBODIMENTS

Figure 1:
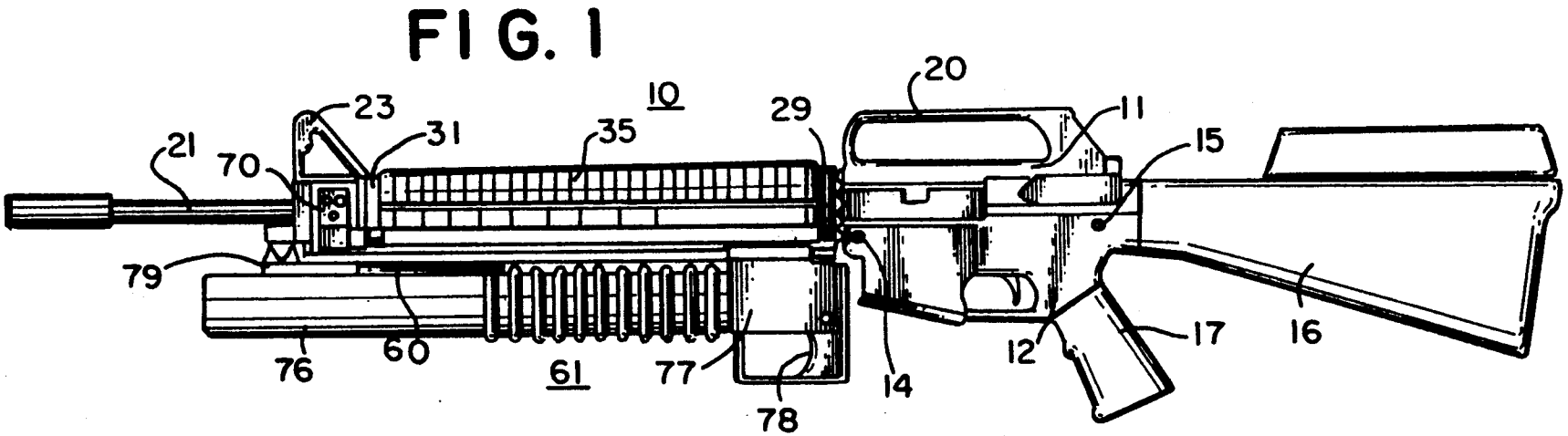
FIG. 1 is a side elevational view of an M-16 type rifle with the mount of the invention thereon, and which carries a flare launcher.
Figure 2:
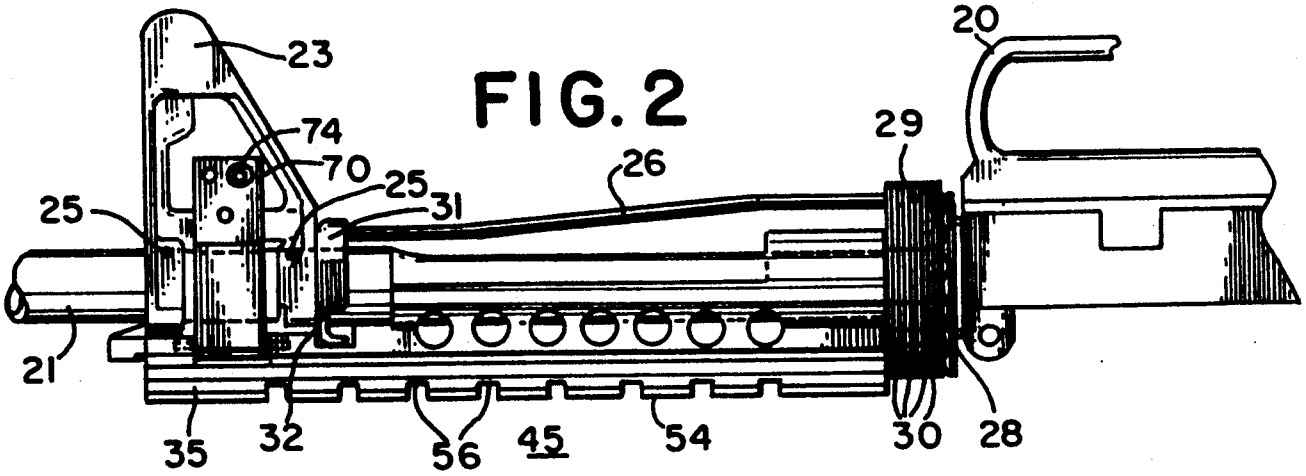
FIG. 2 is a side elevational view, enlarged and broken away, of a portion of the rifle of FIG. 1.
Figure 3:
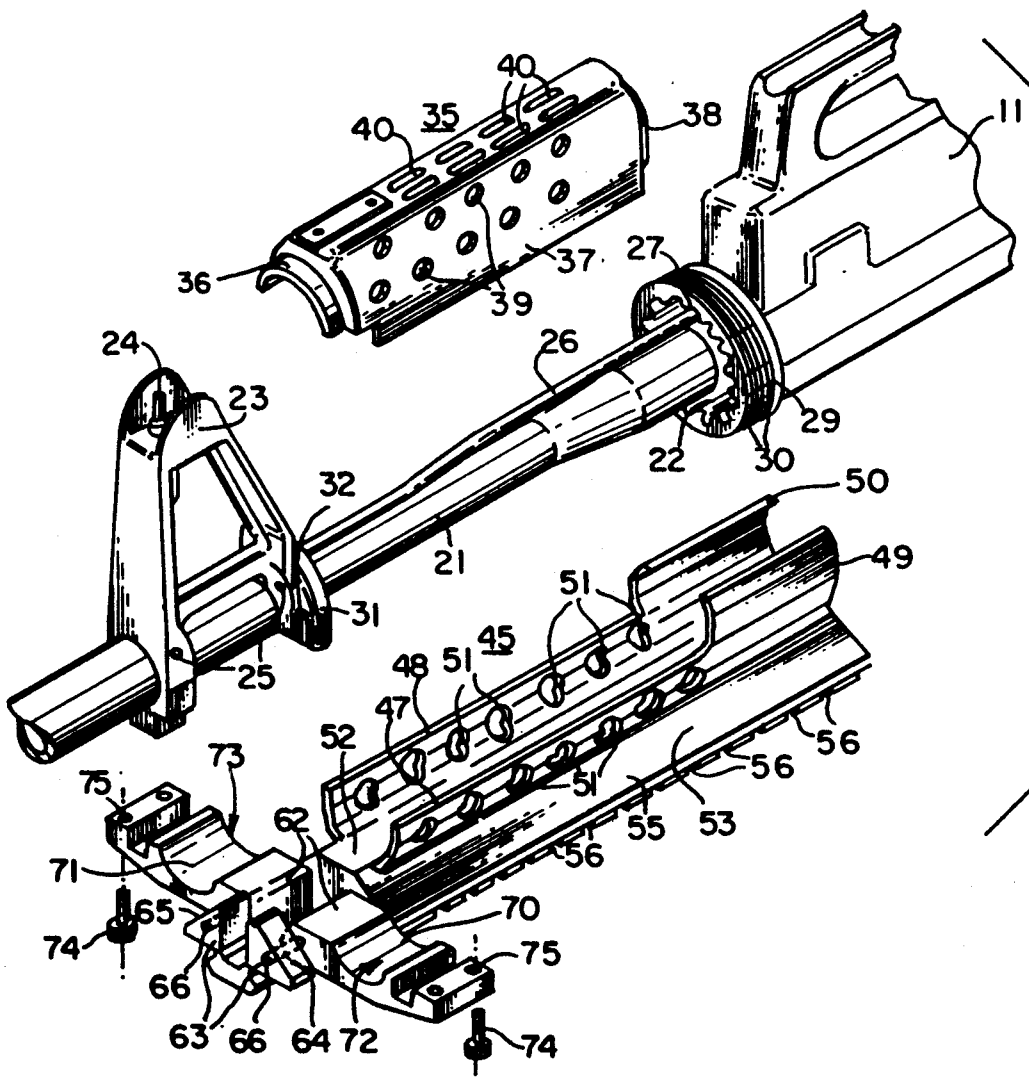
FIG. 3 is an exploded perspective view of the rifle and mount as shown in FIG. 2.

Referring now more particularly to the drawings and FIGS. 1–3 thereof, a rifle 10 of the M-16 type as developed and manufactured by Colt Firearms Division of Colt Industries, Hartford, Conn. is therein illustrated. The rifle 10 has an upper receiver 11, and a lower receiver 12 which are secured together by a pin 14 at the front, and selectively retained together by a pin 15 at the rear, which can be pushed out to allow the upper receiver 11 to pivot about the pin 14. The lower receiver 12 has a buttstock 16 and a hand grip 17.

The upper receiver 11 has a carrying handle 20, and a barrel 21 engaged in a receiver 11, and retained therein by a barrel nut 22.

The barrel 21 has a front sight assembly 23 with an adjustable post 24 therein which assembly is retained on barrel 21 by drift pins 25.

A gas tube 26 is connected to the front sight post 24, and extends back through a notch 27 in the barrel nut 22 to the upper receiver 11, and thence to the bolt (not shown). The barrel nut 22 has a Belleville spring washer 28 engaged therewith, and with a Delta ring 29, which is urged by the spring 28 towards the front sight assembly 23. The Delta ring 29 is round, provided with exterior ribs 30 for ease of gripping, and extends over the nut 22.

A cap 31 is provided on barrel 21, against front sight assembly 23, with a drift pin 32 retaining the cap to the barrel 21.

A handguard 35 is provided which is preferably of molded heat resistant plastic, with a front collar 36, a main body 37, and a rear collar 38. The front collar 36 is captured and retained in cap 31, and the rear collar 38 is captured and retained in the Delta ring 29. A plurality of spaced holes 39 and slots 40 are provided in handguard 35, for air circulation, to cool barrel 21 as required.

A mount 45 is provided and as illustrated, includes a central body 46 with a pair of curved walls 47 and 48, which extend upwardly from body 46 and curve around barrel 21. The walls 47 and 48 have further upwardly extending curved elements 49 and 50 at the rear thereof, which are also engaged by and extend between nut 22 and Delta ring 29.

The walls 47 and 48 are provided with a plurality of openings 51 for air circulation to barrel 21.

The central body 46 of mount 45 as seen in FIG. 3, has a flat top surface 52 and outwardly tapering sides 53 with a flat bottom surface 54, which together form rails 55 of triangular configuration.

The bottom 54 has a plurality of spaced transverse slots 56 thereacross, and which are engaged by a catch such as a lever 60 from a flare launcher 61 as illustrated in FIG. 1.

The central body 46 has a large cut-out 62 and rails 63 extending therefrom, with spaced apart upwardly extending wings 64 and 65, which have pins 66 therein extending to and engaged with the central body 46, and pivotedly carrying a pair of clamps 70 and 71.

The clamps 70 and 71 have cut-outs 72 and 73, to accommodate the barrel 21 in assembled position, and have screws 74 engaged in threaded holes 75 to retain clamp 70 and 71 to barrel 21.

Referring now to FIG. 1, the flare launcher 61 as illustrated is of the M-203 type, and has a barrel 76, a receiver block 77, and a trigger 78. The barrel 76 has a top rib 79, which carries lever 60, which is urged by a spring (not shown) into engagement with a slot 56 in body 46 of mount 45.

The barrel rib 79 is slotted (not shown) to permit it to slide over rails 63, rails 55 and bottom surface 54 which retain it thereon in position for use, and permit ready removal as required.

While a flare launcher 61 is illustrated on mount 45, a variety of other devices can also be used with the mount such as grenade launchers (not shown) and illuminating devices (not shown) of the type disclosed in the E'nama U.S. Pat. No. 5,064,988.

It is thus apparent that apparatus has been described with which the objects of the invention are achieved.

I claim:

1. In combination with a rifle having a receiver, a barrel engaged in the receiver and retained therein by a barrel nut, a resiliently urged Delta ring outside of and extending over the barrel nut, a front sight assembly on the barrel, a front cap on said barrel, the improvement for mounting accessory items under said barrel which comprises:

a longitudinally extending mount having means engaged with said Delta ring and said barrel, said means for engaging said barrel is a pair of clamps carried by said mount, said mount has triangularly shaped side means adapted to receive an accessory item, said mount has a bottom surface, and slots in said bottom surface intended to be engaged with latch means on said accessory item.

2. Apparatus as defined in claim 1 in which:

hand guard means are provided above and around a portion of said barrel, engaged in said Delta ring, and said cap, providing protection to the user from contact with said barrel.

* * * * *